US009161130B2

(12) United States Patent
Adam

(10) Patent No.: US 9,161,130 B2
(45) Date of Patent: Oct. 13, 2015

(54) STEREO TO MONAURAL MULTI-SPEAKER PARALLEL WIRING SYSTEM

(71) Applicant: Ron R. Adam, San Diego, CA (US)

(72) Inventor: Ron R. Adam, San Diego, CA (US)

( * ) Notice: Subject to any disclaimer, the term of this patent is extended or adjusted under 35 U.S.C. 154(b) by 182 days.

(21) Appl. No.: 13/854,794

(22) Filed: Apr. 1, 2013

(65) Prior Publication Data

US 2013/0216048 A1 Aug. 22, 2013

Related U.S. Application Data

(63) Continuation-in-part of application No. 12/049,141, filed on Mar. 14, 2008, now Pat. No. 8,411,878.

(51) Int. Cl.
*H04R 5/02* (2006.01)
*H01R 4/24* (2006.01)

(52) U.S. Cl.
CPC ..... *H04R 5/02* (2013.01); *H01R 4/2408* (2013.01)

(58) Field of Classification Search
CPC ..... H04R 5/02; H04R 29/007; H01R 4/2408
USPC ..... 381/11, 28, 120, 85, 77, 81, 82, 27, 55
See application file for complete search history.

(56) References Cited

U.S. PATENT DOCUMENTS 7,664,273 B2 * 2/2010 Christensen et al. ..... 381/55
8,131,386 B2 * 3/2012 Elberbaum ..... 700/58
2008/0240468 A1 * 10/2008 Adam ..... 381/120

OTHER PUBLICATIONS

Harman International, "Crown XLS Series Operation Manual", Mar. 24, 2010.*
Bohn, "RaneNote_Why not Wye?", Jun. 23, 2006.*
Harman International, "Amplifier application Guide", Jan. 13, 2006.*

* cited by examiner

*Primary Examiner* — Vivian Chin
*Assistant Examiner* — David Ton
(74) *Attorney, Agent, or Firm* — Richard D. Clarke

(57) ABSTRACT

The present invention is directed to a Stereo to Monaural Multi-speaker Parallel Wiring System that uses a standard 200 watt stereo and a whole sound impedance corrector to greatly reduce the wiring connections, the installation time and the overall cost of the system. A whole or complete sound comes from each speaker and will overlap from speaker to speaker so that moving around in different areas or zones within a house or yard, a person will receive the same whole and complete sound. With the master speaker switch box included, different areas or zones can be turned off or on as desired.

20 Claims, 3 Drawing Sheets

STEREO TO MONAURAL MULTI-SPEAKER PARALLEL WIRING SYSTEM

FIELD OF THE INVENTION

This application provides the capability of connecting a plurality of monaural speakers on a single parallel wiring line to a number of different zones where a standard stereo system with an impedance corrector can be used.

BACKGROUND OF THE INVENTION

Stereo sounds are better used for entertainment areas such as movie theaters, on headphones, or at concerts where the sound is better heard in a concentrated area that is commonly called a "sweet spot." In many rooms of the house people are generally active except for possibly the TV room where they usually are seated. In this case a stereophonic sound system is beneficial in watching movies, but is unsatisfactory when they are actively moving from room to room, where it produces different elements of the sound at different locations. By using a Stereo to Monaural Multi-speaker Parallel Wiring System where the whole sound is transmitted throughout the desired rooms the sound is the same.

Additionally, the layout of backyards differ greatly from house to house and people are generally in the backyard doing something, whether that is yard work, having a party, etc. Most people are not standing in one area for a prolonged period at a time, so an involved stereo system in a backyard would also prove to be inadequate. The music being played would not sound ideal to everyone because they would not be able to be in the sweet spot of the speakers. Here the use of a Stereo to Monaural Multi-speaker Parallel Wiring System with the whole sound capability transmitted throughout the desired area, or separate areas would be very effective.

Wireless speakers can be used in some cases where one or two work well but would be very expensive to be put through the house or yard. They require batteries that will be drawn down with extended use or a power connection to each speaker. These are not a practical solution for a back yard or throughout a house sound system.

The existing US patent application publication US 2008/0240468 A1 of Ron R. Adam the inventor of the landscape speaker connector and sound system relates to an outdoor monaural music and sound system. More particularly, this system incorporates weather proof wiring cable connectors used in connecting a plurality of weatherproof speakers on a single electrical line to a remote sound system that may be employed in a variety of landscape areas. By using 8 ohm at 20 to 50 watt resistor unit, or a 1.5 to 2 ohm receiver amplifier to control the output, a single cable can be used to connect a plurality of speakers. This patent deals primarily with the wiring connections and an outdoor music and sound system.

Where the Stereo to Monaural Multi-speaker Parallel Wiring System patent application differs is that most conventional stereo amplifiers do not have a monaural to FM or stereo switch and the 4 channel mixer with a monaural switch is required. This addition compared to using a standard 200 watt stereo and an impedance corrector greatly reduces the wiring connections, the installation time and the overall cost of the system and making the use of the Stereo to Monaural Multi-speaker Parallel Wiring System more desirable. By using the Stereo to Monaural Multi-speaker Parallel Wiring System a whole or complete sound comes from each speaker and will overlap from speaker to speaker so that moving around in different areas a person will receive the same whole or complete sound.

Numerous innovations for the Stereo to Monaural Multi-speaker Parallel Wiring System have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the Stereo to Stereo to Monaural Multi-speaker Parallel Wiring System and the prior art.

U.S. Pat. No. 7,920,708 of Steven D. Trautmann describes a method of converting single channel audio (mono) signals to two channel, audio (stereo) signals using simple filters and an Intra-aural Time Difference (ITD) is presented. This method does not distort the spectral content of the original signal very much, and has low computation requirements. A variation is proposed which also uses intra-aural Intensity Difference (IID).

This patent describes a method of converting single channel audio (mono) signals to two channel audio (stereo) signals using simple filters and an Intra-aural Time Difference (ITD). It does not have the capability of converting stereo to monaural by using the whole sound impedance corrector to be used in an in house or landscape application.

U.S. Pat. No. 6,714,652 of Stephen A. Davis describes a system and method that are for rendering a left rear surround input signal at a left rear virtual speaker location and rendering a right rear surround input signal at a right rear virtual speaker location. The method includes phase shifting the left rear surround input signal by a first phase shift. The right rear surround input signal is phase shifted by a second phase shift. The phase shifted left rear surround input signal is phase shifted using an HRTF selected to render the left rear surround input signal at the left rear virtual speaker location. The phase shifted right rear surround input signal is transformed using an HRTF selected to render the right rear surround input signal at the right rear virtual speaker location.

This patent describes a system and method that are for rendering a left rear surround input signal at a left rear virtual speaker location and rendering a right rear surround input signal at a right rear virtual speaker location. It also does not have the capability of converting stereo to monaural to be used in a house or landscape application.

U.S. Pat. No. 6,498,857 of Alastair Sibbald describes a method of synthesizing an audio signal having left and right channels corresponding to an extended virtual sound source at a given apparent location in space relative to a preferred position of a listener in use is described. The information in the channels includes cues for perception of the direction of said virtual sound source from the preferred position. The extended source comprises a plurality of point virtual sources, the sound from each point source being spatially related to the sound from the other point sources, such that sound appears to be emitted from an extended region of space. If the signal from two sound sources is the same, they are modified to be sufficiently different from one another to be separately distinguishable by a listener when they are disposed symmetrically on either side of the listener. This modification can be accomplished by filtering the two point sources using different comb filters.

This patent describes a sophisticated stereophonic sound system but does not have the capability of converting stereo to monaural by using the whole sound impedance corrector to be used in a house or landscape application.

U.S. Pat. No. 6,307,934 of Theodore Calhoun Tanner describes a system and method for providing improved virtual sound images. One or more spatial cues of an audio signal may be modulated within a described range to increase the clarify and perceived localization of a virtual sound image. Interaural time delay, interaural intensity difference and/or spectra may be varied at below the "just noticeable level" to cause the virtual source location to move slightly relative to the listener's head. Such variation assists the listener's auditory system in filtering out ambiguous spatial cue information from the audio signal. The resulting virtual sound image has a larger sweet spot and is less sensitive to head movement.

This patent describes a system and method for providing improved virtual sound images but still does not have the capability of converting stereo to monaural by using the whole sound impedance corrector to be used in a house or landscape application.

None of these previous efforts, however, provides the benefits attendant with the Stereo to Stereo to Monaural Multi-speaker Parallel Wiring System. The present design achieves its intended purposes, objects and advantages over the prior art devices through a new, useful and unobvious combination of method steps and component elements, with the use of a minimum number of functioning parts, at a reasonable cost to manufacture, and by employing readily available materials.

In this respect, before explaining at least one embodiment of the Stereo to Stereo to Monaural Multi-speaker Parallel Wiring System in detail it is to be understood that the design is not limited in its application to the details of construction and to the arrangement of the components set forth in the following description or illustrated in the drawings. The Stereo to Monaural Multi-speaker Parallel Wiring System is capable of other embodiments and of being practiced and carried out in various ways. In addition, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures, methods and systems for carrying out the several purposes of the present design. It is important, therefore, that the claims be regarded as including such equivalent construction insofar as they do not depart from the spirit and scope of the present application.

SUMMARY OF THE INVENTION

The principal advantage of the Stereo to Monaural Multi-speaker Parallel Wiring System that it simplifies the installation of a sound system in a house.

Another advantage of the Stereo to Monaural Multi-speaker Parallel Wiring System is that it simplifies the installation of a sound system in the yard.

Another advantage is that it delivers whole sound in all the locations of the system, and the user can run one wire for 20 plus speakers versus 20 wires for 20 speakers in a conventional system.

A further advantage is a single wiring system can deliver the sound from one to twenty speakers with a small drop in power and a nominal drop in amplitude depending on the number of speakers.

Another advantage of the Stereo to Monaural Multi-speaker Parallel Wiring System is there is no drop in the quality of the sound.

Another advantage of the Stereo to Monaural Multi-speaker Parallel Wiring System is that different areas can be turned off or on as required.

Yet another advantage of the Stereo to Monaural Multi-speaker Parallel Wiring System is that it is much more economical and advantageous than the installation of a complete conventional stereo system requiring that individual wires be run to each of the speakers.

And still another advantage of the Stereo to Monaural Multi-speaker Parallel Wiring System is it uses the same type of speakers or different speakers in all the locations.

A further advantage of the Stereo to Monaural Multi-speaker Parallel Wiring System is that it uses mostly off the shelf parts with only the unique whole sound impedance corrector required.

These together with other advantages of the Stereo to Monaural Multi-speaker Parallel Wiring System along with the various features of novelty, which characterize the design, are pointed out with particularity in the claims annexed to and forming a part of this disclosure. For a better understanding of the Stereo to Monaural Multi-speaker Parallel Wiring System, its operating advantages and the specific objects attained by its uses, reference should be made to the accompanying drawings and descriptive matter in which there are illustrated preferred embodiments of the Stereo to Monaural Multi-speaker Parallel Wiring System.

The disclosed application of the Stereo to Monaural Multi-speaker Parallel Wiring System consists of a media input CD, iPod™, etc. including a TV, sports, news, etc. conventional cable or satellite connection unit and a 110V power input wired to a standard 200 W stereo, radio, CD or iPod™ amplifier. The 200 W stereo units are plugged into the unique whole sound impedance corrector unit with conventional electrical connectors. At the input connection of whole sound impedance corrector will be an overload breaker with a reset button. There are two resister units within the whole sound impedance corrector, each having one wire going to a pair of 3.3 ohm+3.3 ohm=6.6 ohms, 50 watt (W)+50 W=100 W total (or greater) resistance, attached to a cooling element and then connected by a wire to a common connection point. Two additional wires coming from the overload breaker bypass the two resister units and connect directly to a second common connection point. The two common connection points are attached to a female electrical connector in the whole sound impedance corrector unit. A single conventional electrical connector connects the whole sound impedance corrector string of speakers or to a conventional master speaker switch box by the means of a cable. The master speaker switch box has the capability of activating a single speaker or up to 20 or more speakers by placing the speakers into discreet zones, such as zone 1, backyard speakers, zone 2, master bedroom speakers, zone 3, living room speakers, zone 4, bedroom speakers by the means of individual cables separately or all at the same time, or optionally a single zone having one or more speakers. The unit has been tested for 20 speakers but could possibly be used for more than 20 speakers, especially if the system is running with a higher wattage amplifier.

The foregoing has outlined rather broadly the more pertinent and important features of the present Stereo to Monaural Multi-speaker Parallel Wiring System in order that the detailed description of the application that follows may be better understood so that the present contribution to the art may be more fully appreciated. Additional features of the design will be described hereinafter which form the subject of the claims of this disclosure. It should be appreciated by those skilled in the art that the conception and the disclosed specific embodiment may be readily utilized as a basis for modifying or designing other methods for carrying out the same purposes of the present design. It should also be realized by those skilled in the art that such equivalent constructions and methods do not depart from the spirit and scope of this application as set forth in the appended claims.

BRIEF DESCRIPTION OF THE DRAWINGS

The accompanying drawings, which are incorporated in and form a part of this specification, illustrate the Stereo to Monaural Multi-speaker Parallel Wiring System and together with the description, serve to explain the principles of this application.

For a fuller understanding of the nature and advantages of the Stereo to Monaural Multi-speaker Parallel Wiring System, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENTS

Figure 1:
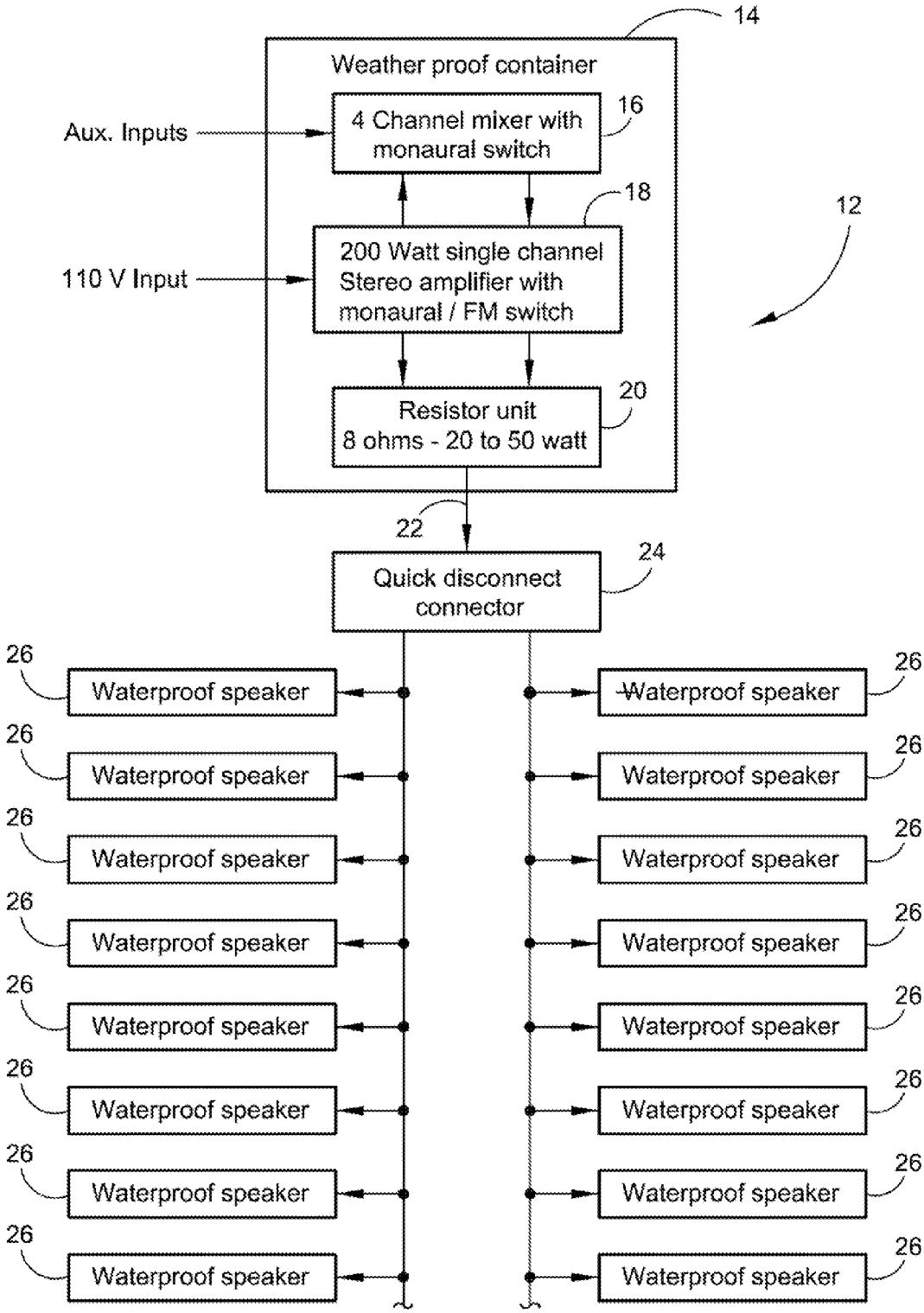
PRIOR ART FIG. 1
FIG. 1 depicts the prior art.

Referring now to the drawings, wherein similar parts of the Stereo to Monaural Multi-speaker Parallel Wiring System 10 are identified by like reference numerals. There is seen in FIG. 1 a block diagram of the prior art 12 of the landscape speaker connector and outdoor music and sound system. More particularly, this system incorporates unique weatherproof wing nut cable connectors used in connecting a plurality of weatherproof speakers on a single electrical line to a remote sound system that may be employed in a variety of landscape areas. By rising 3.3 ohm+3.3 ohm=6.6 ohms. 50 watt (W)+50 W=100 W total (or greater) resistance per stereo channel to control the output, a single cable can be used to connect to a plurality of speakers. This system uses a weather proof container, block 14, that holds the four channel mixer with a monaural switch, block 16, and a 200 watt single channel stereo amplifier with monaural/FM switch, block 18, along with a resister unit having 8 ohms—20 to 50 watts in block 20. A cable 22 from the weather proof container, block 14 attaches to a quick disconnect connector, block 24 that is connected to a polarity of monaural speaker in blocks 26.

Figure 2:
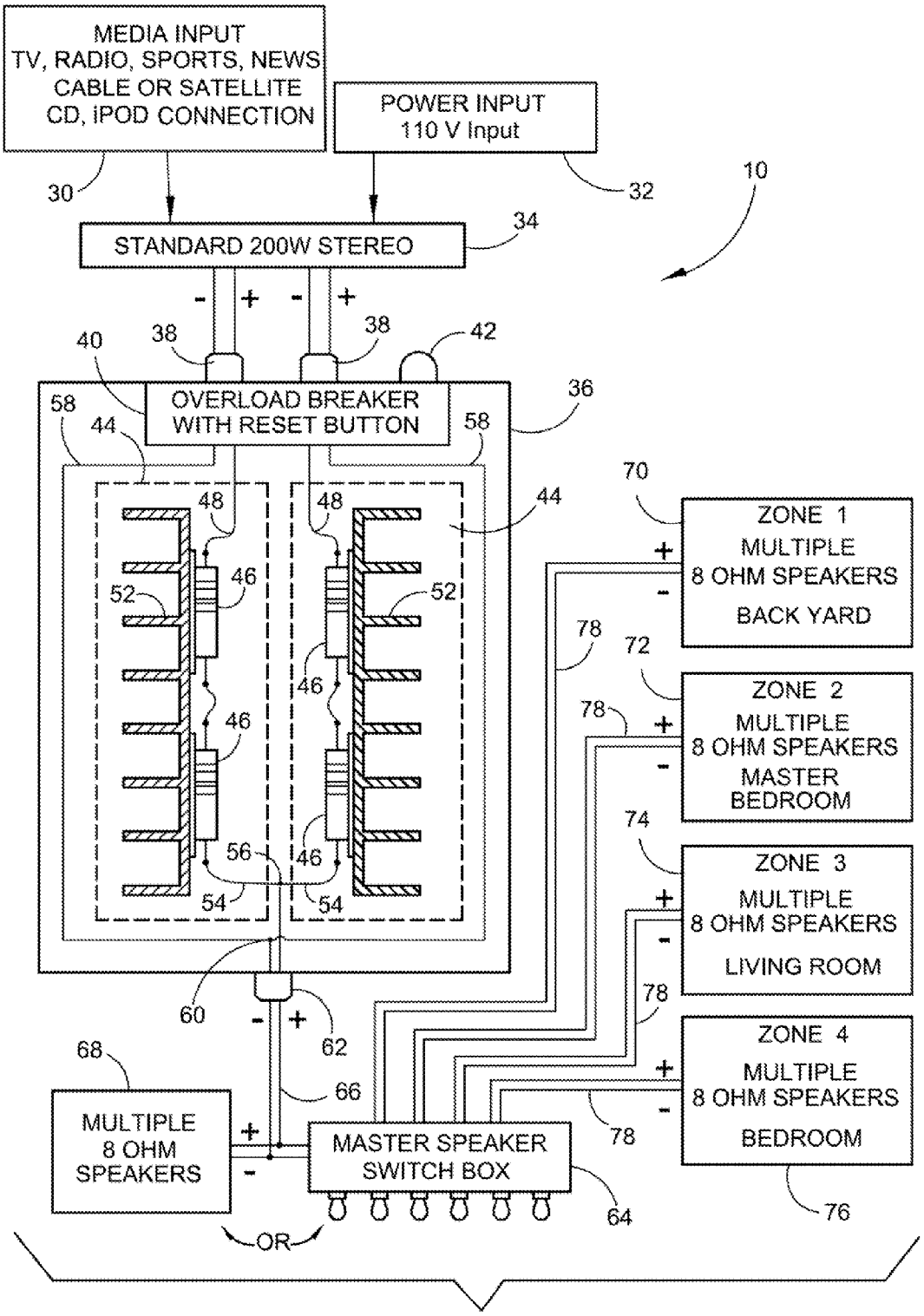
FIG. 2 depicts a block diagram of the Stereo to Monaural Multi-speaker Parallel Wiring System.

FIG. 2 depicts a block diagram of the Stereo to Monaural Multi-speaker Parallel Wiring System 10 consisting of a media input CD, iPod™, etc. including a TV, sports, news, etc. conventional cable or satellite connection unit 30 and a 110V power input, block 32 wired to a standard 200 W stereo, block 34 and plugged into the unique whole sound impedance corrector, block 36 with conventional electrical connectors 38. At the input connection of whole sound impedance corrector, block 36 will be an overload breaker, block 40 with a reset button 42. Two resister units, blocks 44, each, having one wire 48 going to one or more resistors 46 with 3.3 ohm+3.3 ohm=6.6 ohms, 50 watt (W)+50 W=100 W total (or greater) resistance per stereo channel, connected to cooling element 52 and then connected by a wire 54 to a common connection point 56. Two additional wires 58 coming from the overload breaker, block 40 with a reset button 42 bypass the two resister units, blocks 44 and connect directly to common connection point 60. A single conventional electrical connector 62 connects the whole sound impedance corrector, block 36, to the master speaker switch box, block 64 by the means of cable 66 or to the multiple 8 ohm speaker block 68 in a single zone alone having one or more speakers. Therefore, it should be understood that either multiple 8 ohm speaker block 68 or master speaker switch box 64 is used exclusively and not together at the same time.

When the multiple 8 ohm speaker block 68 is used, the whole sound impedance corrector block 36 is connected to a string of speakers in a single zone. When the master speaker switch box is used, block 64 has the capability of activating a single speaker, or up to 20 or more multiple speakers placed into discreet zones, such as zone 1, backyard speakers, block 70, zone 2, master bedroom speakers, block 72, zone 3, living room speakers, block 74, zone 4, bedroom speakers, block 76, by the means of individual cables 78 separately or all at the same time. The unit has been tested for 20 speakers but could possibly employ more than 20 speakers, especially if the system is configured and run using a higher wattage amplifier which is readily commercially available.

Figure 3:
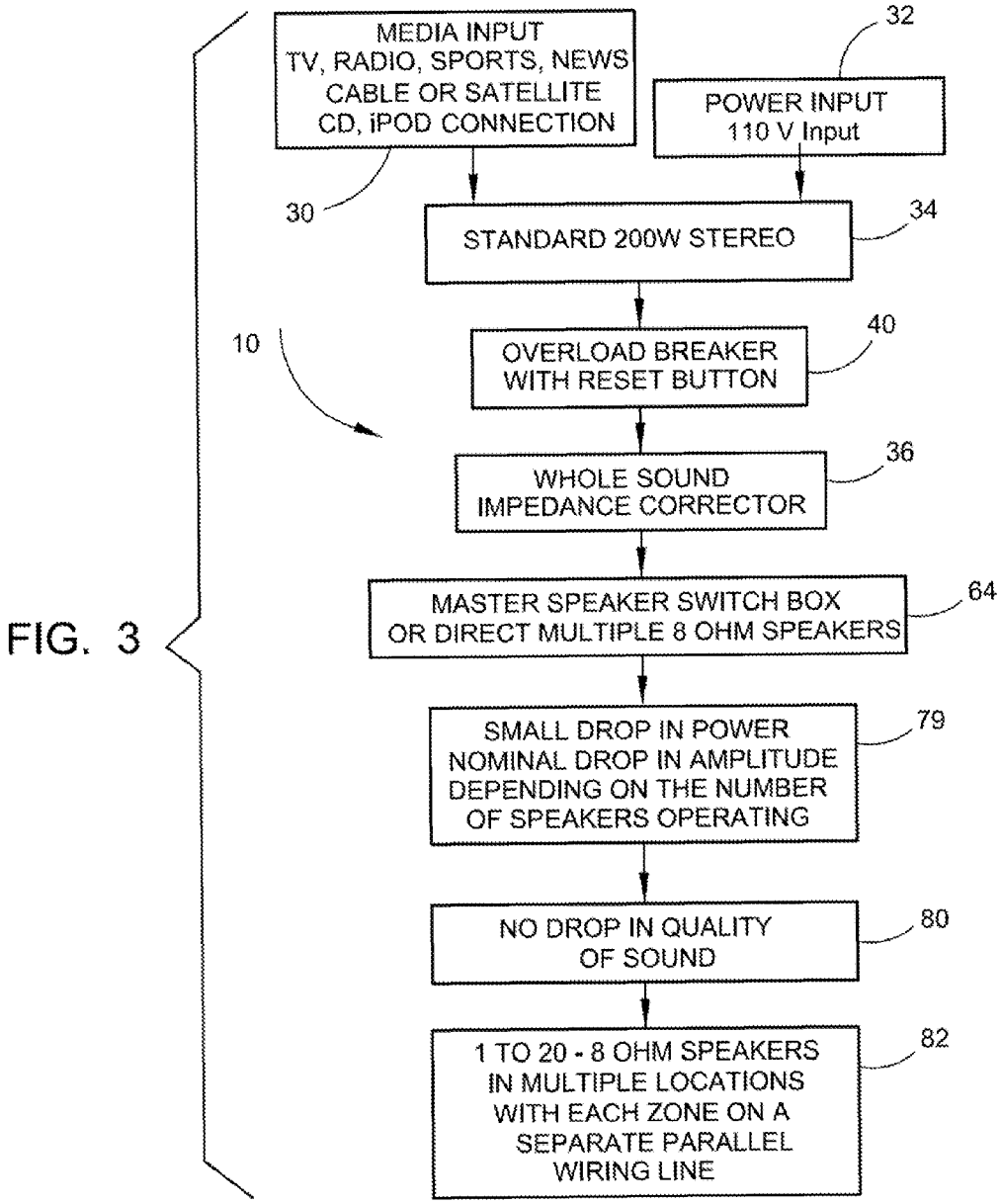
FIG. 3 depicts a block diagram of the benefits of the Stereo to Monaural Multi-speaker Parallel Wiring System.

FIG. 3 depicts a block diagram of the benefits of the Stereo to Monaural Multi-speaker Parallel Wiring System 10 where the conventional cable or satellite connection, block 30 and a 110V power in put; block 32 are connected to a standard 200 W stereo, radio, CD, I Pod amplifier, block 34. An overload breaker with a reset button, block 40 is above the whole sound impedance corrector, block 36. The whole sound impedance corrector, block 36 is connected to the master speaker switch box, block 64 above the block 79 that indicates that a small drop in power and a nominal drop in amplitude depending on the number of speakers operating may occur. Block 80 indicates that there will be no drop in the quality of the sound. Below the block 80 where no drop in quality of sound is shown, block 82 indicates that there can be 1 to 20-8 OHM speakers in multiple locations with each zone on a separate parallel wiring line.

Figure 4:
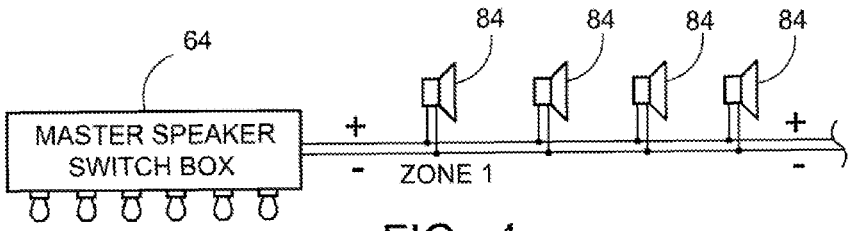
FIG. 4 depicts a diagram illustrating the wiring connections between the speakers of a single zone and the master speaker switch box.

FIG. 4 depicts a diagram showing the wiring connections between the speakers 84 and the master speaker switch box depicted in block 64.

The Stereo to Monaural Multi-speaker Parallel Wiring System 10 shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing a Stereo to Monaural Multi-speaker Parallel Wiring System 10 in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A stereo to monaural multi-speaker parallel wiring system comprising:

a) a media input and a power input connected to a stereo amplifier unit which does not include a stereo to monaural switch;

b) an impedance corrector unit configured as a separate stand-alone component capable of connection to a stereo amplifier unit connected to said stereo amplifier unit, wherein said impedance corrector unit acts as a stereo to monaural switch when connected to said stereo amplifier unit; and c) one or more speakers connected to said impedance corrector unit via a parallel wiring configuration;

whereby said impedance corrector unit converts a stereo sound signal from said stereo amplifier unit which does not include a stereo to monaural switch to a monaural sound signal and sends the monaural sound signal to said one or more speakers using said parallel wiring configuration.

2. The stereo to monaural multi-speaker parallel wiring system according to claim 1, wherein said impedance corrector stand-alone unit component includes a resistor unit further comprising 3.3+3.3+6.6 ohms, 50 watt+50 watt=100 watt resistors per stereo channel.

3. The stereo to monaural multi-speaker parallel wiring system according to claim 1, wherein said impedance corrector stand-alone unit component includes an overload breaker with a reset button.

4. The stereo to monaural multi-speaker parallel wiring system according to claim 1, wherein said impedance corrector stand-alone unit component is connected to a master switch box.

5. The stereo to monaural multi-speaker parallel wiring system according to claim 4, wherein said master switch box is connected to one or more zones of one or more speakers, and controls which zone is turned on.

6. The stereo to monaural multi-speaker parallel wiring system according to claim 5, wherein said zones of one or more speakers is comprised of multiple 8 ohm speakers.

7. The stereo to monaural multi-speaker parallel wiring system according to claim 6, wherein said zones further comprise 1 to 20 or more speakers in multiple locations with each zone on a separate parallel wiring line.

8. The stereo to monaural multi-speaker parallel wiring system according to claim 1, wherein said media input includes a cable, satellite, TV, radio, news, sports, CD and iPod™ connection.

9. The stereo to monaural multi-speaker parallel wiring system according to claim 1, wherein said stereo amplifier unit which does not include a stereo to monaural switch is a 200 or more watt stereo amplifier receiver.

10. The stereo to monaural multi-speaker parallel wiring system according to claim 1, wherein said one or more speakers include one or more 8 ohm monaural speakers.

11. A method for making a stereo to monaural multi-speaker parallel wiring system comprising the steps of:

a) providing a media input and a power input connected to a stereo amplifier unit which does not include a stereo to monaural switch;

b) providing an impedance corrector unit configured as a separate stand-alone component capable of connection to a stereo amplifier unit connected to said stereo amplifier unit, wherein said impedance corrector unit acts as a stereo to monaural switch when connected to said stereo amplifier unit; and c) providing one or more speakers connected to said impedance corrector at via a parallel wiring configuration;

whereby said impedance corrector unit converts a stereo sound signal from said stereo amplifier unit which does not include a stereo to monaural switch to a monaural sound signal and sends the monaural sound signal to said one or more speakers using said parallel wiring configuration.

12. The method for making a stereo to monaural multi-speaker parallel wiring system according to claim 11, wherein said impedance corrector stand-alone unit component includes a resistor unit further comprising 3.3+3.3+6.6 ohms, 50 watt+50 watt=100 watt resistors per stereo channel.

13. The method for making a stereo to monaural multi-speaker parallel wiring system according to claim 11, wherein said impedance corrector stand-alone unit component includes an overload breaker with a reset button.

14. The method for making a stereo to monaural multi-speaker parallel wiring system according to claim 11, wherein said impedance corrector stand-alone unit component is connected to a master switch box.

15. The method for making a stereo to monaural multi-speaker parallel wiring system according to claim 14, wherein said master switch box is connected to one or more zones of one or more speakers, and controls which zone is turned on.

16. The method for making a stereo to monaural multi-speaker parallel wiring system according to claim 15, wherein said zones of one or more speakers is comprised of multiple 8 ohm speakers.

17. The method for making a stereo to monaural multi-speaker parallel wiring system according to claim 16, wherein said zones further comprise 1 to 20 or more speakers in multiple locations with each zone on a separate parallel wiring line.

18. The method for making a stereo to monaural multi-speaker parallel wiring system according to claim 11, wherein said media input includes a cable, satellite, TV, radio, news, sports, CD and iPod™ connection.

19. The method for making a stereo to monaural multi-speaker parallel wiring system according to claim 11, wherein said stereo amplifier unit which does not include a stereo to monaural switch is a 200 or more watt stereo amplifier receiver.

20. The method for making a stereo to monaural multi-speaker parallel wiring system according to claim 11, wherein said one or more speakers include one or more 8 ohm monaural speakers.

* * * * *